US005676322A

United States Patent [19]

Stahlecker

[11] Patent Number: 5,676,322

[45] Date of Patent: Oct. 14, 1997

[54] SPINNING SYSTEM AND METHOD INCLUDING YARN WINDER TUBE DOFFING APPARATUS

[75] Inventor: Fritz Stahlecker, Josef-Neidhart-Strasse 18, 73337 Bad Überkingen, Germany

[73] Assignees: Fritz Stahlecker, Bad Überkingen; Hans Stahlecker, Süssen, both of Germany

[21] Appl. No.: 646,100

[22] Filed: May 7, 1996

[30] Foreign Application Priority Data

May 13, 1995 [DE] Germany ..... 195 17 690.1

[51] Int. Cl.[6] ..... B65H 54/00; B65H 54/02; D01H 13/26

[52] U.S. Cl. ..... 242/18 PW; 57/263; 242/35.5 A

[58] Field of Search ..... 242/18 PW, 35.5 A; 57/263

[56] References Cited

U.S. PATENT DOCUMENTS

| | | | |
|---|---|---|---|
| 3,911,658 | 10/1975 | Smith | 57/263 |
| 4,080,775 | 3/1978 | Stahlecker | 57/263 |
| 4,222,225 | 9/1980 | Stahlecker et al. | 57/263 |
| 4,563,871 | 1/1986 | Stahlecker et al. | 57/263 |
| 4,634,064 | 1/1987 | Burkhard et al. | 242/18 PW |
| 4,920,739 | 5/1990 | Raasch | 57/263 |
| 5,022,222 | 6/1991 | Rupert et al. | 57/263 |
| 5,285,975 | 2/1994 | Mayer et al. | 57/263 X |
| 5,330,115 | 7/1994 | Mayer et al. | 242/18 PW |

FOREIGN PATENT DOCUMENTS

| | | |
|---|---|---|
| 3039857A1 | 5/1981 | Germany . |
| 3123494A1 | 1/1983 | Germany . |
| 3344646A1 | 6/1985 | Germany . |
| 4226364A1 | 4/1993 | Germany . |

*Primary Examiner*—Michael Mansen

*Attorney, Agent, or Firm*—Evenson McKeown Edwards & Lenahan PLLC

[57] ABSTRACT

In order to form a yarn reserve winding on the edge of a rotating empty winder tube after a doffing action on a package-producing spinning aggregate, the rotational speed of a drive roller which drives the winder tube is kept constant. The delivery speed of a delivery device, which draws the yarn from the spinning aggregate and delivers it to the winder tube, can be regulated. The yarn tension between the delivery device and the winder tube is thus kept constant during the forming of the yarn reserve winding as well as during and after the transfer of the yarn to a traversing device.

24 Claims, 4 Drawing Sheets

25
44
93
94
21
20
22
91
92
43
18
19
16
23
24
15
2
88
14
13
52
30
89
90
61

SPINNING SYSTEM AND METHOD INCLUDING YARN WINDER TUBE DOFFING APPARATUS

BACKGROUND AND SUMMARY OF THE INVENTION

The present invention relates to a device for forming a yarn reserve winding at the edge of a rotating empty winder tube after a doffing action on a package-producing spinning aggregate. A drive roller is provided for the winder tube pressed thereagainst. A delivery device for drawing off the yarn from the spinning aggregate and delivering it to the winder tube and a yarn guide for guiding the yarn to the edge of the winder tube are provided. After the forming of the yarn reserve winding, the yarn guides the yarn to the middle of the tube for the purpose of transferring it to a traversing device. For the purpose of keeping the yarn tension essentially constant between the delivery device and the winder tube from the beginning of the formation of the yarn reserve winding up to the transfer of the yarn to the traversing device, the delivery speed of the delivery device and the circumferential speed of the drive roller can be varied in relation to one another.

It is known from the German published patent application 30 39 857 A1 that in a normal winding process, the winder tube has to be driven at lower speeds than at the beginning of the winding process-due to the longer path of the yarn as a result of the yarn traverse motion-when at the edge of the winder tube a yarn reserve winding is formed without traverse motion. The yarn reserve winding would otherwise be too loose or the operational tension of the yarn would be too high. While the yarn reserve winding is being formed, the empty winder tube is supported between three roller pairs and driven with increased speed ratio by a frictional wheel connection of the delivery device which is located on the frame of the machine. After the formation of the yarn reserve winding, the winder tube is transferred over to a winder roller located on the frame of the machine, whereby the operational yarn traverse motion begins simultaneously. In the case of the known device consideration has not been made of the fact that in the transition period between the end of the yarn reserve winding formation and the beginning of the yarn traverse motion, differential yarn paths and thus differential yarn tensions exist. Thus during the transition period, the winding-on to the winder tube is too loose.

In the case of another device according to U.S. Pat. No. 4,501,116, the winder tube is driven at operational winding speed during the yarn reserve winding formation, preferably by means of an auxiliary winder roller of a travelling maintenance device. The yarn surplus which arises due to the lack of a yarn traverse motion is temporarily taken up by a yarn storer, so that the yarn reserve winding is sufficiently taut. After the operational yarn traverse motion has begun, the yarn storer empties, as, during normal operation, the winder roller runs somewhat quicker than the delivery device which delivers the yarn. In the case of this device, a certain controlled tautness of the yarn is guaranteed during the transition phase between the end of the yarn reserve winding formation and the beginning of the traverse motion, but the tautness caused by the yarn storer differs from the operational yarn tension.

In the case of a further device according to U.S. Pat. No. 4,634,064, no delivery roller pair is inserted between the yarn withdrawal duct of an open-end spinning aggregate and the winder tube driven by a winder roller located on the frame of the machine. The delivery roller pair is open during the forming of the yarn reserve winding, so that the spinning tension has a direct effect on the yarn. The yarn reserve winding is thus formed sufficiently taut without the presence of a yarn storer or without the speed of the winder tube having to be altered. Shortly before the traversing thread guide seizes the yarn, the previously open delivery roller pair shuts so that the operational tension between the delivery device and the winding device comes into effect. This tension differs however from the spinning tension which was effective during the formation of the yarn reserve winding.

It is known from U.S. Pat. No. 5,330,115 that during the formation of the yarn reserve winding, the winder tube is lifted from the winder roller located on the machine frame and driven by an auxiliary winder roller of a maintenance device. The delivery speed of the yarn from the spinning aggregate remains constant. The auxiliary winder roller is infinitely variable in its speed and driven in such a way that the yarn tension always corresponds to the operational tension, that is, the yarn tension present during normal yarn traversing. This applies to the duration of the actual formation of the yarn reserve winding as well as to the subsequent transitional phase, until the yarn has been transferred to the traversing thread guide and the winder tube has been placed again on the winder roller located on the machine frame. The yarn is delivered continuously at a constant speed. There is however, at every change in speed of the auxiliary winder roller, a small uncontrolled slip between the latter and the winder tube, so that the speed adaption of the winder tube does not take place sufficiently spontaneously. Thus it is not certain whether the winder tube takes up exactly the same yarn length as delivered by the delivery device.

It is an object of the present invention to improve the above mentioned device in such a way that the yarn tension can be controlled in a very exact way.

This object has been achieved in accordance with the present invention in that the circumferential speed of the drive roller is maintained constant and the delivery speed of the delivery device is controlled to be variable.

As the yarn itself is practically inertia-free, the yarn speed can be adjusted spontaneously at any time to the prevailing conditions by controlling the speed of the delivery device. During the formation of the yarn reserve winding, when no yarn traverse motion is present, less yarn can be delivered than during the operational winding and also during the transitional phase for transferring the yarn to the yarn traverse motion, when the yarn is transferred from the edge of the winder tube to the middle of the winder tube. The speed of the yarn delivered to the winder tube is adjusted to the respective length of path, so that the yarn tension can be held constant at any given time. This also takes into consideration that when using conical winder tubes the diameter at the point of the yarn reserve winding and the average diameter during the operational driving of the winder tube are not the same.

The delivery device is preferably a component of a maintenance device which travels along a plurality of spinning aggregates. The delivery device of the maintenance device must be so programmed that it is adjustable to the reduced speed normal during doffing. It is therefore advantageous to use the same delivery device also during the formation of the yarn reserve winding at the edge of the winder tube and during the transitional phase to the operational traversing device. This takes place by means of a controlled delivery roller pair.

For the production of delicate, in particular fine yarns, it can be provided that during the formation of the yarn reserve winding the yarn tension is measured and that the speed of the delivery roller pair is adjustable to that tension. A sensor can be provided for measuring the yarn tension, to which a servo component for controlling the delivery roller pair is arranged. If, for example, the sensor reads a too-low yarn tension before the yarn is wound onto the winder tube, the speed of the delivery rollers can be accordingly reduced, while in the case of a too-high yarn tension, the opposite reaction occurs.

It is not important if, during a short transitional phase, as a result of a change in the delivery speed, the yarn count is changed for a short time. In a further embodiment of the present invention, however, in conformation with the alterable delivery speeds of the delivery device, an auxiliary drive can be provided which varies the feeding speed of yarn material to the spinning aggregate. Such auxiliary drives are technically standard during the normal piecing process today and can be used to control the feeding speed of the yarn material during formation of the yarn reserve winding. Thus during the formation of the yarn reserve winding and the transfer of the yarn to the traversing device, the yarn count can be held exactly constant.

In a modified device it is provided that the delivery device comprises an uncontrolled delivery roller partly surrounded by the yarn. In this case the yarn, drawn off from the spinning aggregate and delivered to the winder tube, runs with a sufficient covering around only a single roller, whereby a "non-rigid taking-along" arises. In the case of such a taking-along, there are no tension peaks, as the yarn is able to execute small, compensating sliding movements on the surface of the delivery roller. With this solution the delivery roller can aid the withdrawing of the yarn from the spinning aggregate and even it out. If, for example, the yarn tension between the delivery roller and the winder tube was too low, the yarn would be pressed less strongly against the delivery roller and thus the taking-along effect would be diminished, which would mean that somewhat less yarn length would be drawn off from the spinning aggregate.

Advantageously the driving roller is also the winder roller which drives the cross wound package during normal spinning. As a constant drive roller speed forms the basis of the present invention, it is clear that the operational winder roller is also used for the formation of the yarn reserve winding. Any speed jumps are avoided here from the outset.

Alternatively, the drive roller can be an auxiliary winder roller, which drives the winder tube only during the formation of the yarn reserve winding and which is arranged on a maintenance device. This type of auxiliary roller is necessary in any case for a piecing process, and can therefore also be deployed for the formation of the yarn reserve winding. However, it is, as already mentioned, more purposeful to use the operational winder roller because of the desired speed constancy of the drive roller.

These and further objects, features and advantages of the present invention will become more readily apparent from the following detailed description thereof when taken in conjunction with the accompanying drawings.

DETAILED DESCRIPTION OF THE DRAWINGS

Figure 1:
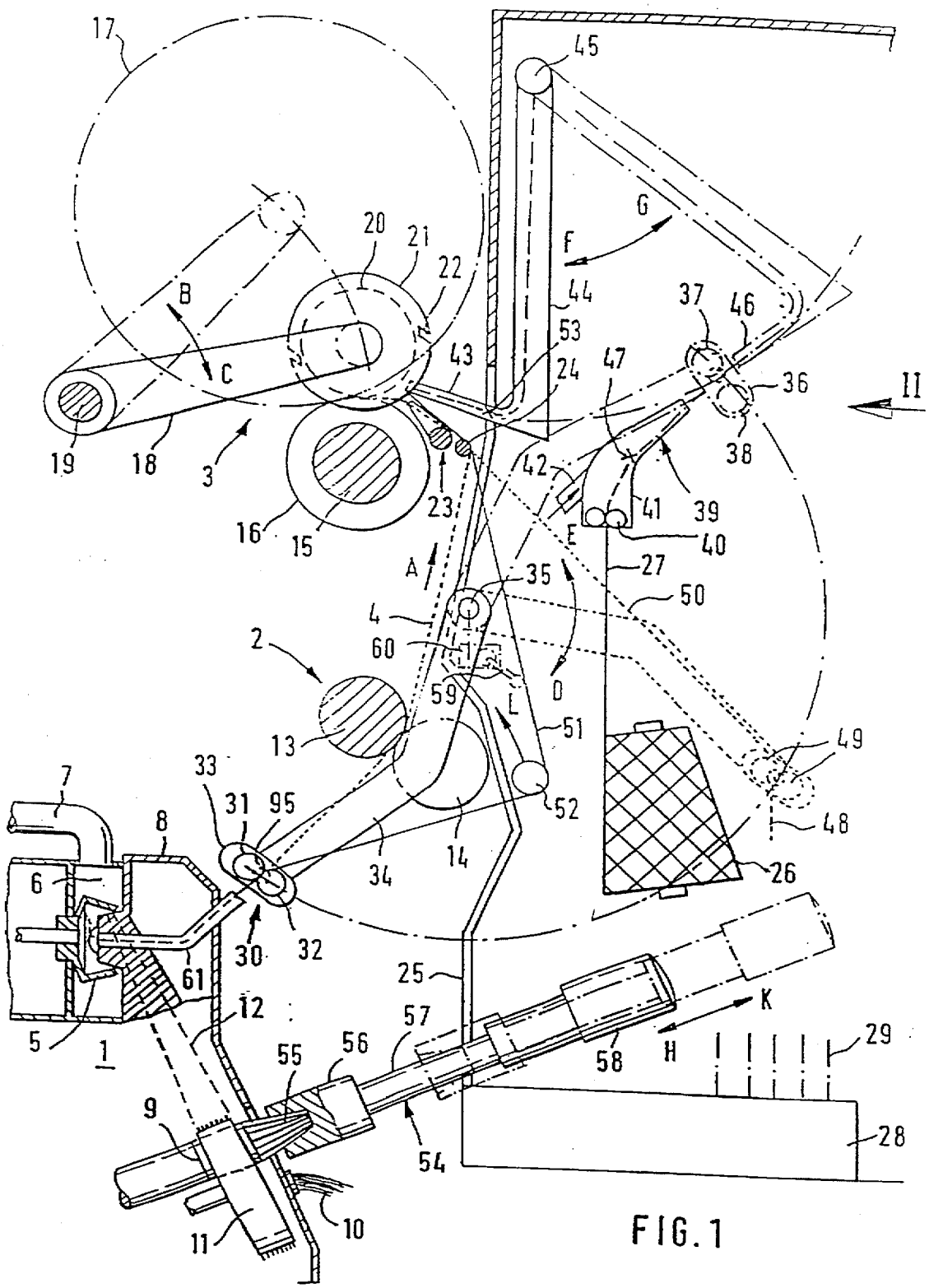
FIG. 1 is a partly sectional schematic side view of a spinning aggregate and of a maintenance device operating thereon, with the aid of which maintenance device a yarn reserve winding is being formed, constructed according to a preferred embodiment of the present invention.

The spinning aggregate 1 according to FIG. 1 is an open-end spinning aggregate of the type concerned with rotor spinning. Arranged at the spinning aggregate I are a delivery roller pair 2 and a winding device 3 both located on the machine frame for the yarn 4 spun during operation and represented by a dotted line. The path direction of the yarn 4 is denoted by A. The spinning aggregate 1 comprises a rotatably driven spinning rotor 5, which rotates in a vacuum chamber 6, which in turn is connected to a vacuum conduct 7. The open front side of the spinning rotor 5 and the vacuum chamber 6 is enclosed by a lid-like housing 8 in a known way.

The housing 8 takes up a feed roller 9 for feeding yarn material 10 in the form of a card or drawing frame sliver, and an opening roller 11 for opening the fiber material 10 to single fibers. A fiber feed channel 12, which feeds the single fibers to the spinning rotor 5 in the known way, is guided from the opening roller 11 into the spinning rotor 5. During operation, the yarn 4 in a fiber collecting groove of the spinning rotor 5 is drawn off through a yarn withdrawal duct 61 by means of the delivery roller pair 2 and fed to the winding device 3 (see the dotted path of the yarn 4).

The delivery roller pair 2 comprises a driven delivery cylinder 13 which extends continuously in longitudinal direction of the machine, thus being arranged to extend along a plurality of spinning aggregates 1. The delivery roller pair 2 also comprises a top roller 14, which is always arranged at a single spinning aggregate 1 and which rests on the delivery cylinder 13 by means of frictional connection.

The winding device 3 comprises a drive cylinder 15, also extending continuously in longitudinal direction of the machine and being arranged to extend along all spinning aggregates 1 on a machine frame. A winder roller 16 is present at each spinning aggregate 1, which is arranged tightly coupled on the drive cylinder 15. During operation, a cross wound package 17, denoted only by a dot-dash line, rests on the winder roller 16.

The winding device 3 comprises further one creel 18 per spinning aggregate 1, which is swivel-mounted around a swivel axle 19 secured to the machine according to the denoted swivel directions B and C. The creel 18 takes up, in the known way, a winder tube 20 by means of two side winder plates 21. One of the winder plates 21 comprises at least one collecting slit 22, whose function is described below. It should be mentioned at this point that the winder roller 16 in the embodiment according to FIG. 1 is also the drive roller for the winder tube 20 during the formation of a Yarn reserve winding 63 (not shown in FIG. 1).

A traversing device 23 forms part of the winding device 3, which, during the normal winding process, places the yarn 4 onto the package 17. A yarn guide 24, which extends upstream of the traversing device 23 in the direction of the yarn path and which is located on the machine frame, also forms part of the winding device 3.

As can be seen in FIG. 1, with increasing fullness of the package 17, the creel 18 gradually swivels in arrow direction B. As soon as the package 17 has reached the desired fullness, it is exchanged for a new empty winder tube 20. This is done in the known way by means of a maintenance device 25 which travels the length of the spinning aggregates 1. In the known way, which will not be described here in more detail, the spinning process is interrupted in order to allow the exchange of winder tubes, after which a piecing process takes place whereby spinning begins again.

Piecing takes place after doffing by means of an auxiliary winder package 26, from which an auxiliary yarn 27 is fed back to the spinning aggregate 1 by working elements of the maintenance device 25. The auxiliary yarn 27 does not however reach the winder tube 20, but is guided away beforehand in a way to be described below.

A program control unit 28 controls the maintenance device 25. Connecting wires 29 are guided from program control unit 28 to the individual working elements of the maintenance device 25, described in more detail below.

One of these working elements is a delivery device 30 which comprises a delivery roller pair 31,32. The delivery roller pair 31,32 is arranged at a bearing support 33. The delivery device 30 is disposed on a swivel arm 34, which is swivel-mounted around a swivel axle 35 of the maintenance device 25. The swivel directions are denoted by D and E.

The delivery device 30 can be moved into an upper position 36, denoted by a dot-dash line, in which the delivery roller pair 31,32 takes up an open position 37,38, that is, it temporarily does not form a nipping line. A feeder 39 for the auxiliary yarn 27 is arranged adjacent to this position 36 of the delivery device 30. The feeder 39 comprises a feed roller pair 40, which keeps the auxiliary yarn 27, connected to the auxiliary winder package 26, constantly nipped. The feeder 39 comprises further an air guiding channel 41, which is located downstream of the feed roller pair 40. The air guiding channel 41 is directed against the delivery roller pair 31,32 in their open position 37,38. Compressed air, in conjunction with the rotational movement of the feed roller pair 40, can be blown into the air guiding channel 41 through an injector 42, so that the auxiliary yarn 27 is placed in the open nipping roller pair 31,32. The end of the auxiliary yarn 27 is taken up by a suction nozzle 43, which is swivel-mounted by means of a suction arm 44 around a swivel axle 45, also formed as a vacuum channel, the said suction nozzle 43 being movable into a position 46 denoted by a dot-dash line. The swivel directions are denoted by F and G.

A certain length of auxiliary yarn 27 is placed through the open delivery roller pair 31,32 by means of the feeder 39 and taken up by the suction nozzle 43 which is in position 46. A cutting device 47 located in the feeder 39 cuts the auxiliary yarn 27 which is still held securely in the now out of operation feed roller pair 40. The yarn end 48 arising therefrom (see the intermediate position 49 of the delivery roller pair 31,32 in the meantime closed again, denoted by a dotted line) projects a short distance out of the delivery device 30. The bearing support 33 is rotated during the swivel movement of the swivel arm 34 in arrow direction D around an axle 95 in such a way that the yarn end 48 is turned towards the delivery tube 61. An intermediate position of the auxiliary yarn 27 is denoted by 50 and shown by a dotted line.

The actual spinning position of the auxiliary yarn 27 is denoted by 51, that is when the delivery device 30 has taken up the position denoted by a continuous line and the suction nozzle 43 has also been swivelled in arrow direction F to take up the position shown by a continuous line. The swivel movement of the suction arm 44 conforms with the swivel movement of the swivel arm 34, so that the yarn path 50, denoted by a dotted line, can be transferred to the position 51 of the auxiliary yarn 27, denoted by a continuous line. The yarn to be pieced is thereby placed over a yarn guide 52, which is a component of the maintenance device 25. The yarn guide 52 serves later to transfer the yarn to be pieced in arrow direction L to the delivery roller pair 2 located on the machine frame.

The auxiliary yarn 27, in the piecing position 51, starts spinning after being fed back into the delivery tube 61 and into the spinning rotor 5. The delivery roller pair 31,32 of the delivery device 30 can reverse their rotational direction after the actual piecing, so that the pieced yarn, which is still identical to the yarn path 51, can be drawn off again. The yarn does not run onto the winder tube 20, but rather is still held by the suction nozzle 43. This comprises a cutting device 53 in its interior, which becomes active as soon as the actual piecing point has passed it. Almost simultaneously, the pieced yarn is wound to form a yarn reserve winding 63 at the edge 62 of the winder tube 20 in a way which will be described below (see FIG. 2).

In order that the yarn count remains constant during piecing and during the subsequent drawing-off of the pieced yarn, the maintenance device 25 is provided with an auxiliary drive 54, by which the feed roller 9 can be temporarily driven externally. After a yarn breakage, the feeding of yarn material 10 is interrupted temporarily by stopping the feed roller 9. The auxiliary drive 54 is engaged by a bevel gear 55, connected securely to the feed roller 9, through a mating gear 56. The driving shaft 57 of the mating gear 56, driven by a motor 58 in the maintenance device 25, is movable in directions H and K. After a maintenance process, the mating gear 56 separates from the bevel gear 55, whereby the feed roller 9 is then connected again to its machine frame drive.

It is as a rule not necessary to measure the tension of the yarn during formation (to be described below) of the yarn reserve winding 63, as the geometry of the yarn paths is known. If it should be necessary or desirable to measure the yarn tension after a piecing process, a sensor 59 can be applied to the maintenance device 25. The sensor 59 can be moved to the yarn path between the yarn guide 52 and the winder tube 20, so that the respective yarn tension can be directly scanned. The yarn tension can be altered by means of a servo component 60 by altering the delivery speed of the delivery roller pair 31,32.

As can be seen in particular in FIG. 2, after a doffing process a yarn reserve winding 63 is formed at the edge 62 of the newly replaced winder tube 20, so that in later procedural stages a plurality of packages 17 can be linked together. During formation of the yarn reserve winding 63, the yarn (see position 51), fed by the delivery roller pair 31,32 in delivery direction M, is not moved by the traversing device 23. The position 51 of the pieced auxiliary yarn 27 is reached hereby by means of a yarn guide 64, whose function will be described below with the aid of FIG. 3.

Figure 2:
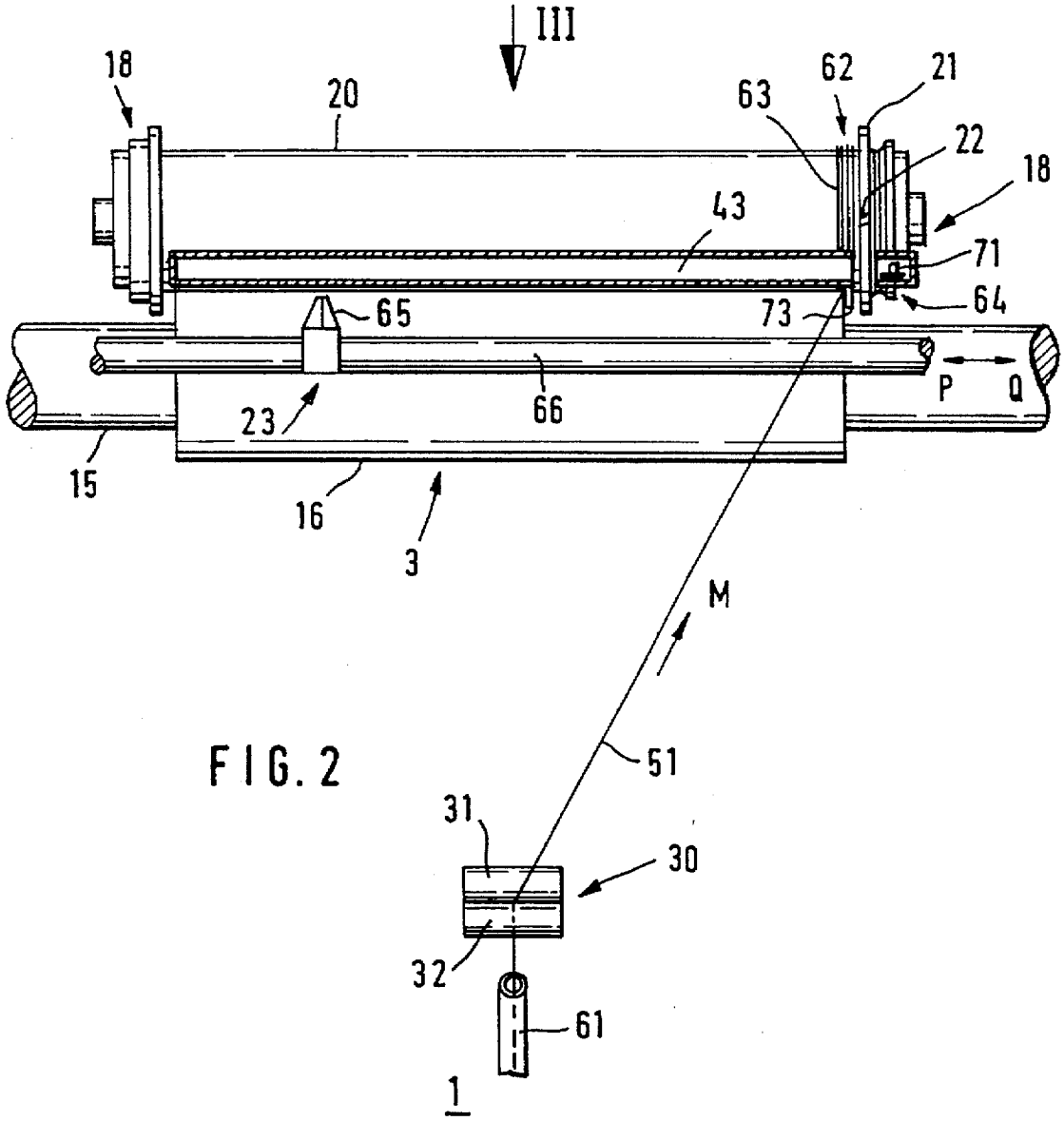
FIG. 2 is a view in arrow direction II of FIG. 1, wherein several components have been omitted to aid in illustration of the system.

It can be seen from FIG. 2 that the traversing device 23 comprises a traversing yarn guide 65, which is secured to a traversing bar 66 which traverses in arrow directions P and Q. The traversing bar 66 extends, as does the drive cylinder 15 of the winding device 3, in longitudinal direction of the machine past a plurality of spinning aggregates 1.

It can furthermore be seen from FIG. 2 that during the formation of the yarn reserve winding 63, the yarn path extending in arrow direction M is significantly shorter than it would be if it were moved by means of the traversing yarn guide 65 for the subsequent forming of the package 17. In order that the yarn reserve winding 63 is wound onto the winder tube 20 with the same tension as the yarn during operation, the delivery speed of the delivery device 30 of the maintenance device 25 is controllable. The circumferential speed of the winder tube 20, in contrast, remains constant, as the latter rests continuously on the winder roller 16 during the formation of the yarn reserve winding 63. The winder roller 16 is thus the drive roller for the winder tube 20 during the formation of the yarn reserve winding 63, and runs at a constant speed.

The controlled delivery speed of the delivery device 30 enables the feeding speed of the yarn to the winder tube 20 to be exactly controlled not only during the formation of the yarn reserve winding 63, but also then when the yarn is transferred to the traversing device 23 after formation of the yarn reserve winding 63 is completed. For this purpose, the yarn (yarn path 51) must be transferred over to the winder center (to be described below) whereby the length of the yarn path between the delivery device 30 and the winder tube 20 is altered. After the yarn has been seized by the traversing yarn guide 65, the length of the yarn path changes again, so that the delivery speed of the delivery device 30 must be altered again. In the case of a conical winder tube being used instead of a cylindrical one, the larger diameter of the former being located in the area of the yarn reserve winding 63, also the change in diameter must be taken into consideration when altering the speed of the delivery device 30.

Furthermore, it can be seen from FIG. 2 that the winder plate 21, located on the right side, comprises one or more collecting slits 22. This collecting slit 22 serves the purpose of seizing the yarn delivered by the delivery device 30 and temporarily held by the suction nozzle 43 and thus to bring it to the edge 62 of the winder tube 20 for the formation of the yarn reserve winding 63. As soon as the yarn has been seized by the collecting slit 22, the cutting device 53 in the inside of the suction nozzle 43 comes into operation. The shortened piece of yarn located in the suction nozzle 43 is wound up in a yarn groove 77 (see FIG. 3) on the right hand side of the winder plate 21 and later cut off and removed as waste.

Figure 3:
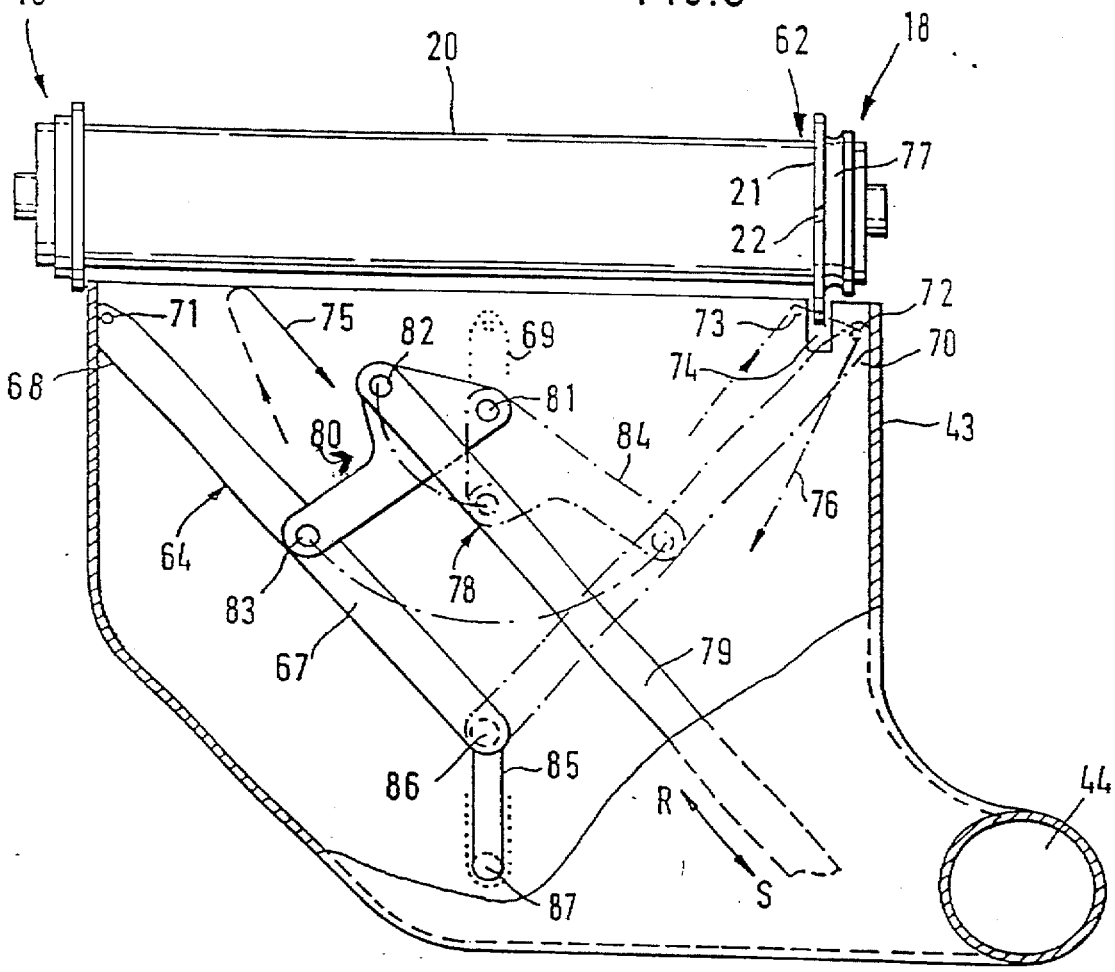
FIG. 3 is a view in arrow direction III of FIG. 2.

It can be seen from FIG. 3 how the suction nozzle 43 is led very close to the winder tube 20 and how the yarn guide 64 transfers the yarn delivered by the delivery device 30 to the winder tube 20.

The yarn guide 64 comprises a pendulum yarn guide 67 arranged in the inside of the suction nozzle 43, which guide can take up various positions 68, 69 and 70. Position 68 is located in FIG. 3 on the left-hand edge of the suction nozzle 43, position 70 (shown by a dot-dash line) on the right-hand edge and position 69 (shown by dotted line) in a central intermediate position. The pendulum yarn guide 67 is provided with a yarn guide pin 71 at its free end, which also makes pendulum movements and can be transferred over from the left-hand edge of the suction nozzle 43 to a position 72 on the right-hand edge of the suction nozzle 43.

Near the position 72 of the yarn guide pin 71, a finger 73 is located, projecting downwards, on the outside of the suction nozzle 43, (see FIG. 2), namely directly on the mouth edge of the suction nozzle 43. The suction nozzle 43 is provided in this area with a slit 74, into which the winder plate 21, provided with the collecting slit 22, can project. The arrangement is such that the finger 73 in FIG. 3 is located on the left-hand side of the winder plate 21 and the position 72 of the yarn guide pin 71 is located on the right-hand side of the winder plate 21 when the suction nozzle 43 is arranged at the winder tube 20 for the formation of the yarn reserve winding 63.

The yarn guide 64 is at first not active, the yarn guiding pin 71 being located at first on the left-hand side of the suction nozzle 43, denoted by a continuous line. The yarn, according to the denoted yarn path 75, comes from underneath to the suction nozzle 43 and reaches into the inside of the suction nozzle 43 up to the suction arm 44. As soon as the pendulum yarn guide 67 is set in motion, so that the yarn guiding pin 71 is transferred to the position 72, the yarn guide pin 71 can cross the yarn path 75, located at any point, and taking it with it to the right-hand side of the suction nozzle 43 (see the dot-dash yarn path 76). The yarn is thus forced to wind around the finger 73 and the yarn guiding pin 71, which is in position 72. The short piece of yarn between the finger 73 and the yarn guiding pin 71 can then be seized by the collecting slit 22 of the rotating winder plate 21.

As soon as the yarn path 76 is cut by the cutting device 53 of the suction nozzle 43, a yarn reserve winding 63 (not shown in FIG. 3 but see FIG. 2) forms at the edge 62 of the winder tube 20, while to the right of the collecting slit 22, in a yarn groove 77, a piece of winding of the yarn end which was previously in the suction nozzle 43 is formed. As the pieced auxiliary yarn 27 and the actual piecing point have already been guided away by means of the suction nozzle 43 before the cutting device 53 came into action, only flaw-free spun yarn is wound onto the winder tube 20.

The drive of the pendulum yarn guide 67 is described in the following:

A lifter rod 79 is located in the inside of the suction nozzle 43, which rod is driven to execute traverse motion movements by a drive motor (not shown) according to the arrow directions R and S. The lifter rod 79 acts on a link point 82 of a coupling link 80, which can be swivelled around a swivel pin 81 in the inside of the suction nozzle 43, whereby the swivel movements are caused by the traverse motion movements of the lifter rod 79. The pendulum yarn guide 67 is linked onto a second link point 83 of the coupling link 80.

The coupling link 80 can move from one end position, denoted by a continuous line, to the other end position 84, denoted by a dot-dash line. The pendulum yarn guide 67 thus moves from the position 68 through the position 69, denoted by a dotted line, to the position 70, denoted by a dot-dash line.

The link point 83 of the pendulum yarn guide 67 is located approximately in the middle between the yarn guide pin 71, which is arranged at the outmost end of the pendulum, and a sliding pin 86, which is secured to the other end of the pendulum yarn guide 67. The sliding pin 86 can move in a slot guide 85 inside the suction nozzle 43. When the pendulum yarn guide 67 has reached its middle position 69 (dotted intermediary position), the sliding pin 86 is located in the position 87 at the end of the slot guide 85. As soon as the pendulum yarn guide 67 has reached the position 70, the sliding pin 86 is located again in the position at the beginning of the slot guide 85. The yarn guiding pin 71 executes a purely linear movement when transferring to the position 72.

As soon as the yarn piece shortened in the inside of the suction nozzle 43 has wound itself on the yarn groove 77 of the winder plate 21, the pendulum yarn guide 67 swivels back into the position 68. The finger 73 takes the yarn located between the delivery device 30 and the edge 62 of the winder tube 20 to the middle of the winder tube 20. The continuously traversing yarn guide 65 seizes the yarn at some point, which then goes over to operational traverse motion.

During the entire process of piecing, the formation of the yarn reserve winding 63 and the transfer of the yarn to the traversing device 23, the delivery device 30 is controlled by the program control 28. The auxiliary drive 54 is simultaneously adapted to the controlled delivery speed of the delivery device 30. The yarn tension is thus kept constant, practically inertia-free, during the formation of the yarn reserve winding 63 and during the phase thereafter.

Figure 4:
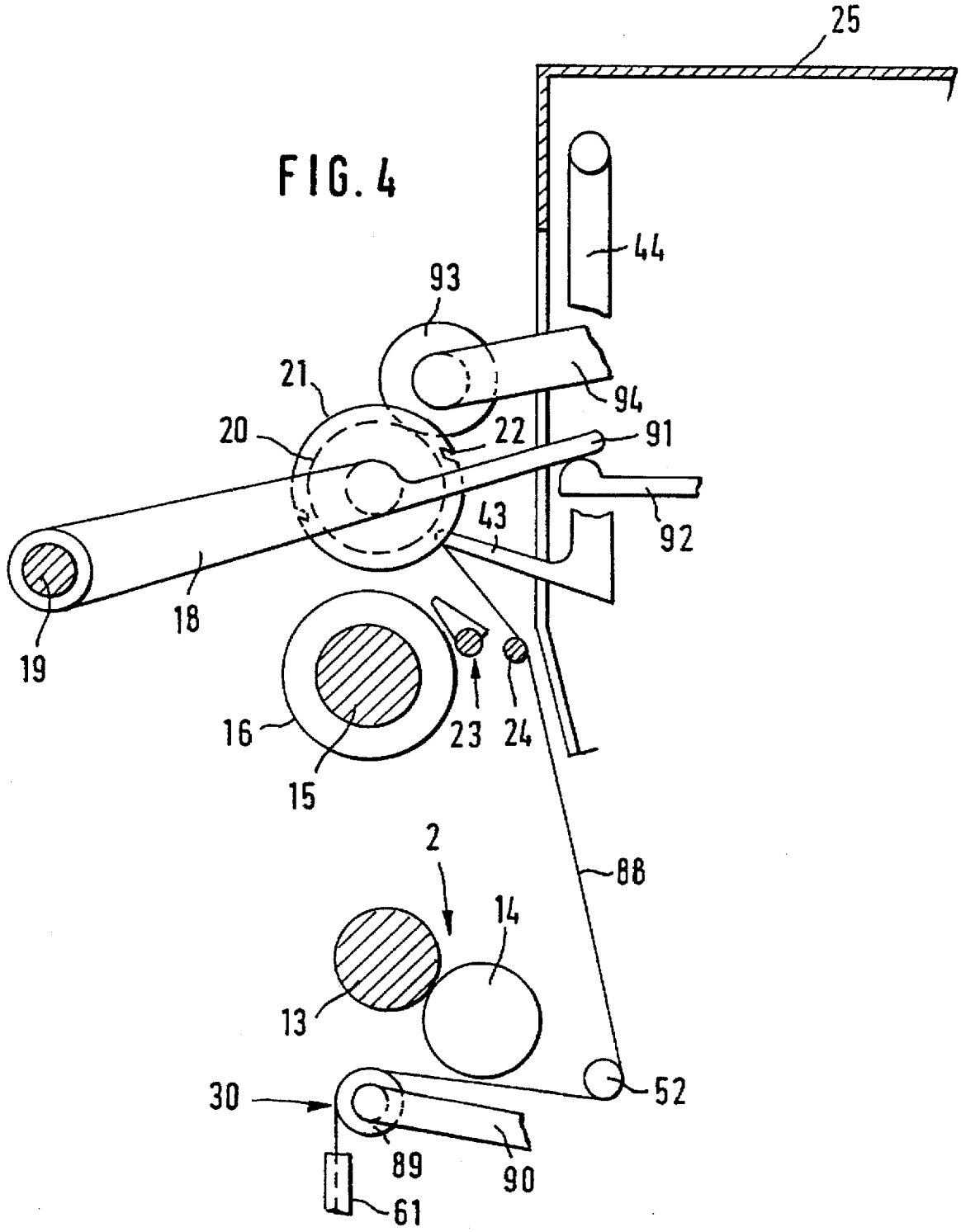
FIG. 4 is a partial view of FIG. 1 of a modified embodiment of the present invention.

Although the embodiment described above is the preferred one, the present invention can also be applied to an altered form according to FIG. 4:

FIG. 4 shows an alternative yarn path 88 between the yarn delivery duct 61 and the suction nozzle 43. Here it is first provided that the delivery device 30 of the maintenance device 25 does not comprise a delivery roller pair 31, 32, but rather only a delivery roller 89, the yarn path 88 being looped around a larger part of its circumference. The delivery roller 89 is arranged on a feeder arm 90 of the maintenance device 25 and, in this case, is not controlled. Should the tension of the yarn change during the yarn path 88, this results inevitably in the yarn lying more or less fixedly on the delivery roller 89. If, for example, the yarn tension lessens, the looping of the yarn around the delivery roller 89 is looser, whereby the delivery speed from the yarn delivery duct 61 is inevitably reduced. The slight yarn count change in the drawn-off yarn can, in practice, be tolerated for that short time.

According to FIG. 4, the creel 18 is provided with an extension 91, against which a lifter arm 92 of the maintenance device 25 can be placed from underneath, so that the winder tube 20 can be raised from the winder roller 16 of the machine. An auxiliary winder roller 93, which is arranged on a feeder lever 94 of the maintenance device 25, can be arranged to the winder tube 20 from above. This arrangement is purposeful during a normal piecing process. According to FIG. 4, the auxiliary winder roller 93 can also be used during the formation of the yarn reserve winding 63 as a drive roller for the winder tube 20. The embodiment can be applied in connection with the delivery roller 89 as in FIG. 4 as well as in connection with the delivery roller pair 31, 32 as in FIGS. 1 to 3. As soon as the yarn has been transferred back to the traversing device 23 after formation of the yarn reserve winding 63, the winder tube 20 is placed again on the winder roller 16 of the machine by pulling back the lifter arm 92. In this case, however, attention must be paid that the circumferential speed of the auxiliary winder roller 93 has practically exactly the same speed as the circumferential speed of the winder roller 16, so that no speed jumps occur during transfer. For this reason, the embodiment in FIG. 1 is preferred.

Although the invention has been described and illustrated in detail, it is to be clearly understood that the same is by way of illustration and example, and is not to be taken by way of limitation. The spirit and scope of the present invention are to be limited only by the terms of the appended claims.

What is claimed is:

1. Doffing apparatus for forming yarn reserve windings at an edge of a winder tube during a doffing operation with said tube driven by a drive roller at a constant speed, wherein the doffing device comprises a delivery device for drawing off a yarn from a spinning aggregate during the doffing operation and a system for transferring the yarn to an edge of said winder tube and from there to a traversing device of the spinning aggregate, and wherein the delivery speed of the delivery device is controlled for keeping yarn tension essentially constant during formation of the reserve windings and during transfer of the yarn to the traversing device.

2. Doffing apparatus for a yarn spinning aggregate of the type having a spun yarn supply, a yarn winder tube driven at a constant speed, and a yarn traversing device between the spun yarn supply and the yarn winder tube, said doffing apparatus comprising:

a delivery device for delivering yarn from the yarn supply, and a yarn transfer device accepting yarn from the delivery device and sequentially transferring the yarn to an edge of said winder tube to form yarn reserve windings and then to the yarn traversing device for resumption of normal spinning operations, wherein yarn delivery speeds of the delivery device are controlled so as to maintain constant yarn tension in the yarn during formation of the yarn reserve windings and transfer to the yarn traversing device.

3. Apparatus according to claim 2, comprising a movable maintenance carriage carrying said delivery device, said carriage being selectively movable between respective ones of a plurality of spinning aggregates.

4. Apparatus according to claim 3, wherein the delivery device includes a pair of delivery rollers which engage opposite sides of said yarn during yarn delivery.

5. Apparatus according to claim 4, wherein the yarn winder tube is driven by a constant speed drive roller during normal spinning operations and during doffing operations utilizing said doffing apparatus.

6. Apparatus according to claim 4, comprising an auxiliary winding roller of the maintenance carriage which drives the winder tube during formation of the yarn reserve winding.

7. Apparatus according to claim 3, wherein the yarn winder tube is driven by a constant speed drive roller during normal spinning operations and during doffing operations utilizing said doffing apparatus.

8. Apparatus according to claim 3, comprising an auxiliary winding roller of the maintenance carriage which drives the winder tube during formation of the yarn reserve winding.

9. Apparatus according to claim 3, wherein said plurality of spinning aggregates includes a commonly driven constant speed drive roller engageable with respective ones of the winder tubes at the respective spinning aggregates.

10. Apparatus according to claim 2, comprising a sensor sensing yarn tension during formation of the yarn reserve winding, said sensor being connected to a control element for controlling the yarn delivery speeds of the delivery device.

11. Apparatus according to claim 2, wherein the delivery device comprises a delivery roller around a large part of the circumference of which the yarn is looped, said delivery roller being driven at a constant sped.

12. Apparatus according to claim 2, wherein the yarn winder tube is driven by a constant speed drive roller during normal spinning operations and during doffing operations utilizing said doffing apparatus.

13. A yarn spinning system comprising:

a plurality of yarn spinning aggregates disposed adjacent one another and each having a spun yarn supply, a yarn winder tube, and a yarn traversing device between the spun yarn supply and the yarn winder tube, and doffing apparatus selectively operable at respective ones of the spinning aggregates and comprising:

a delivery device for delivering yarn from the yarn supply, and a yarn transfer device accepting yarn from the delivery device and sequentially transferring the yarn to an edge of said winder tube to form yarn reserve windings and then to the yarn traversing device for resumption of normal spinning operations, wherein yarn delivery speeds of the delivery device are controlled so as to maintain constant yarn tension in the yarn during formation of the yarn reserve windings and transfer to the yarn traversing device.

14. A yarn spinning system according to claim 13, wherein said spinning aggregates are open end rotor spinning aggregates.

15. A yarn spinning system according to claim 13, wherein a common constant speed drive roller drives respective yarn winder tubes of a plurality of said spinning aggregates.

16. A yarn spinning system according to claim 13, comprising a movable maintenance carriage carrying said delivery device, said carriage being selectively movable between respective ones of the plurality of spinning aggregates.

17. A yarn spinning system according to claim 13, wherein the delivery device includes a pair of delivery rollers which engage opposite sides of said yarn during yarn delivery.

18. A yarn spinning system according to claim 17, wherein a sensor is provided for measuring the yarn tension during formation of the yarn reserve windings, which sensor is connected to a control element for controlling the speed of the pair of delivery rollers.

19. A method of doffing a winder tube at a spinning aggregate of the type having a spun yarn supply, a yarn winder tube driven at a constant speed, and a yarn traversing device between the spun yarn supply and the yarn winder tube, said method comprising:

delivering spun yarn from the yarn supply by way of a delivery device, and accepting yarn from the delivery device utilizing a yarn transfer device and sequentially transferring the yarn to an edge of said winder tube to form yarn reserve windings and then to the yarn traversing device for resumption of normal spinning operations, wherein yarn delivery speeds of the delivery device are controlled so as to maintain constant yarn tension in the yarn during formation of the yarn reserve windings and transfer to the yarn traversing device.

20. A method according to claim 19, comprising a movable maintenance carriage carrying said delivery device, said carriage being selectively movable between respective ones of a plurality of spinning aggregates.

21. A method according to claim 20, wherein the delivery device includes a pair of delivery rollers which engage opposite sides of said yarn during yarn delivery.

22. A method according to claim 19, wherein said control of the yarn delivery speeds of the delivery device includes sensing yarn tension during formation of the yarn reserve winding and controlling yarn delivery speeds as a function of the sensed yarn tension.

23. A method according to claim 19, wherein the yarn winder tube is driven by a constant speed drive roller during normal spinning operations and during doffing operations utilizing said doffing apparatus.

24. A method according to claim 19, wherein said plurality of spinning aggregates includes a commonly driven constant speed drive roller engageable with respective ones of the winder tubes at the respective spinning aggregates.

* * * * *